United States Patent [19]

Takamaru et al.

[11] 4,167,547

[45] Sep. 11, 1979

[54] AIR VALVE TYPE CARBURETOR

[75] Inventors: Takeshi Takamaru; Tohru Nakagawa, both of Ibaraki, Japan

[73] Assignee: Hitachi, Ltd., Japan

[21] Appl. No.: 943,130

[22] Filed: Sep. 18, 1978

[30] Foreign Application Priority Data

Sep. 17, 1977 [JP] Japan ..... 52-111767

[51] Int. Cl.[2] ..... F02M 9/06

[52] U.S. Cl. ..... 261/44 C; 123/119 EC; 261/DIG. 74

[58] Field of Search ..... 261/44 C, DIG. 74; 123/119 EC

[56] References Cited

U.S. PATENT DOCUMENTS

| | | | |
|---|---|---|---|
| 3,243,167 | 3/1966 | Winkler | 261/44 C |
| 3,455,260 | 7/1969 | Mennesson | 261/44 C |
| 3,900,014 | 8/1975 | Bundesen et al. | 261/44 C |
| 4,079,713 | 3/1978 | Laprade et al. | 261/44 C |
| 4,117,046 | 9/1978 | Nohira et al. | 261/44 C |

FOREIGN PATENT DOCUMENTS

| | | | |
|---|---|---|---|
| 46-12323 | 3/1971 | Japan | 261/44 C |
| 46-28728 | 8/1971 | Japan | 261/44 C |
| 52-46234 | 10/1977 | Japan | 261/44 C |

*Primary Examiner*—Tim R. Miles

*Attorney, Agent, or Firm*—Craig and Antonelli

[57] ABSTRACT

An air valve type carburetor comprises a pressure transducer provided for detecting pressure in the venturi portion of the carburetor and putting out electric signals corresponding to the pressure, a passage for introducing vacuum from a suction passage for supplying air-fuel mixture into an engine downstream of a throttle valve provided in the suction passage into a suction chamber containing slidably one end of a suction piston the other end of which is disposed in the suction passage for providing the venturi portion, an electromagnetic valve provided on the passage, and a control unit. The control unit receives electrical signals from the pressure transducer, compares the electric signals with a reference valve and put out electric signals corresponding to the difference. The electromagnetic valve controls vacuum induced into the suction chamber through the passage according to signals from the control unit so that the pressure in the venturi portion will be constant.

5 Claims, 3 Drawing Figures

AIR VALVE TYPE CARBURETOR

BACKGROUND OF THE INVENTION

This invention relates to improvements in an air valve type carburetor in which a venturi opening-area is varied in response to a vacuum level or a negative pressure prevailing in a venturi portion so that it is maintained substantially constant.

In an air valve type carburetor, a throttle valve is provided within a horizontal air intake passage of a carburetor, a suction piston housed in a suction chamber is provided upstream of the throttle valve to move so that a vacuum level is maintained substantially constant, and a jet needle having a tapered portion is secured to the bottom of the suction piston to move within a nozzle communicating with a float chamber. The air valve type carburetor has a feature that a vacuum level in the venturi portion is maintained substantially constant irrespective of changes of running conditions as above-mentioned. Precisely stated, the vacuum level prevailing in the venturi portion increases a little in proportion to elevation of the suction piston because a suction spring is compressed to increase its compression force as the suction piston elevates. However, a desired air-fuel ratio is obtained always because the jet needle is formed not is a straightly tapered shape but in a curvilinearly tapered shape in section. Thus, in a usual operation, a good air-fuel ratio is obtained, but under a transitional running condition in which a running condition is abruptly changed, the suction piston is delayed largely in operation due to its momentum and the air-fuel ratio changes largely for a while. This phenomenon can not be expected to be avoided even if a method in which the suction piston is controlled by detection of exhaust gas compositions of an engine is adopted, because about 0.5 second is necessary for the exhaust gas to reach a detector for detecting the exhaust gas compositions, so that the operation delay can not be avoided.

Therefore, apparatus or device such that even under a transitional condition, a good air-fuel ratio can be obtained is desired.

As a relevant prior art, there is Japanese Laying-open of Patent Application No. 46234 (1977) which has a similarity that a vacuum level in an upper piston chamber 10*a* is controlled by an electromagnetic valve 17.

SUMMARY OF THE INVENTION

An object of the invention is to provide an air valve type carburetor which is suitable for providing a good air-fuel ratio.

Another object of the invention is to provide an air valve type carburetor which is suitable for providing a constant air-fuel ratio which is little changed at a time of transitional operation in acceleration of an engine.

Briefly stated, a feature of the invention is that pressure or vacuum in a venture portion of a suction passage with a throttle valve in an air valve type carburetor is detected, and vacuum in the suction passage downstream of the throttle valve is induced into a suction chamber containing therein part of a suction piston another part of which forms a part of the venturi portion, so that a vacuum level in the venturi portion will be constant.

DESCRIPTION OF THE PREFERRED EMBODIMENT

Figure 1:
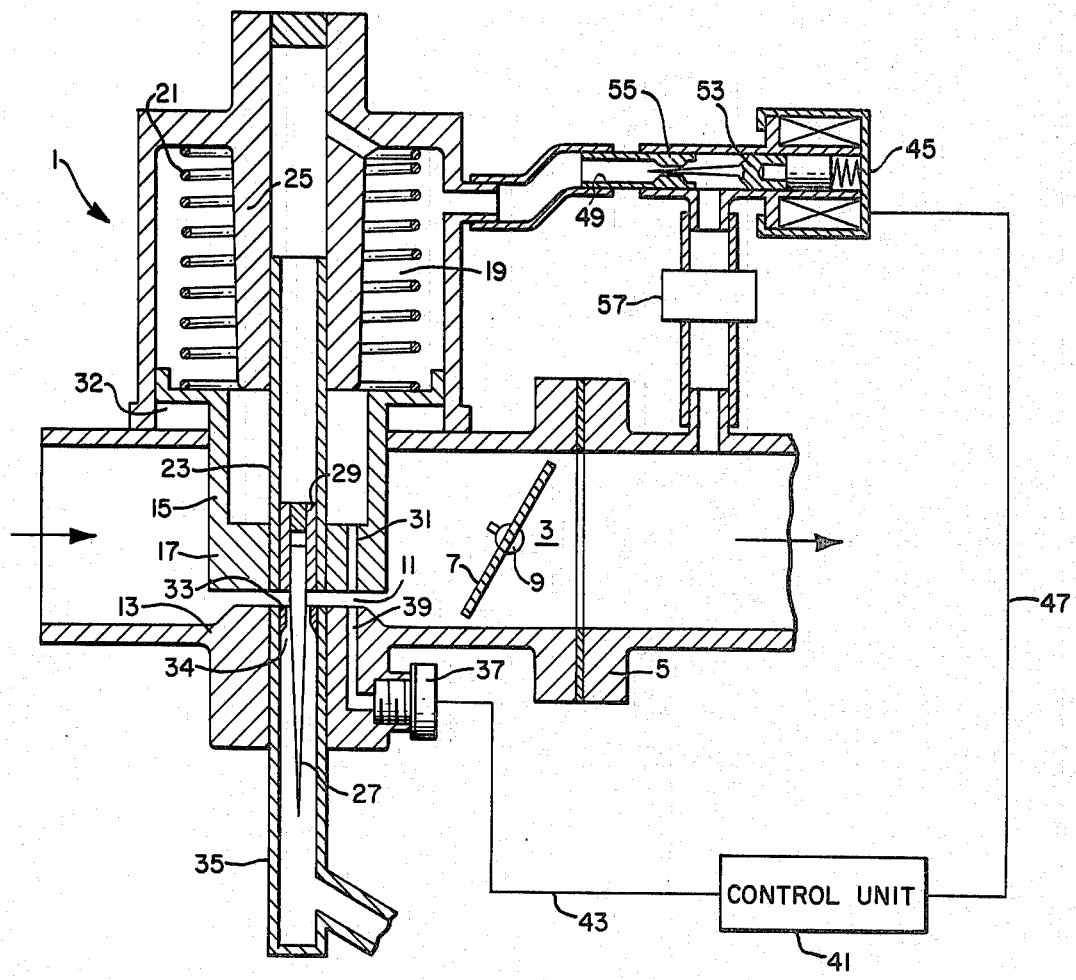
FIG. 1 is a section view of an embodiment of an air valve type carburetor according to the invention.

Referring to FIG. 1, an embodiment of an air valve type carburetor according to the invention will be described hereinafter in detail.

In FIG. 1, the air valve type carburetor 1 (hereinafter called simply the carburetor) is provided with a suction passage 3 defined by a suction pipe 5. In the suction passage 3, a throttle valve 7 is disposed, with a shaft 9 for securing it being rotatally mounted on the suction pipe 5. The suction passage 3 has a venturi portion 11 upstream of the throttle valve 7. The venturi portion 11 is defined by a fixed venturi forming portion 13 formed with a part of suction passage wall, and a suction piston 15. A lower end 17 of the suction piston 15 is projected into the suction passage 3 through a hole made in the suction passage wall, the other end is disposed in a suction chamber 19 in which a spring 21 is disposed to urge the suction piston 15 downward. In the lower end 17 of the suction piston 15, a pipe 23 is secured. The pipe 23 is slidebly inserted in a guide 25 provided in the suction chamber 19. A jet needle 27 extending downward is secured to the lower end 17 of the suction piston 15 through a bush 29. The suction chamber 19 communicates with the suction passage 3 through an aperture 31 made the lower end 17 of the suction piston 15. An air chamber 32 communicates with the atmosphere so that pressure in the air chamber 32 will be constant irrespective of moving of the suction piston 15. The jet needle 27 is inserted in an orifice 33 secured to a nozzle or cylinder 35 which is rigidly mounted on the venturi forming portion 13. The cylinder 35 communicates with a float chamber (not shown) to such fuel according to a vacuum level in the venturi portion 11.

In the suction passage wall near the venturi forming portion 13, a pressure transducer 37 for detecting pressure and producing electric signals or electric current proportional to the pressure is provided. The pressure transducer 37 which comprisen, for example a silicon diaphragm receiving pressure, and semi-conductor strain gages secured to the diaphragm communicates with the venturi portion 11 through a vacuum passage 39 made in the venturi forming portion 13, and it is electrically connected to control unit 41 or function generator through wires 43. The control unit 41 amplifys the electric signals from the pressure transducer 37 and compares the electric signals with an electric value corresponding to a reference pressure such as about-250 mmAq. to produce electric signals or current proportional to the difference between the electric signals from the pressure transducer 37 and the reference value. The control unit 41 is electrically connected to a electromagnetic valve 45 through wires 47. The electromagnetic valve 45 is provided on a vacuum passage 49 through which the suction chamber 19 communicates with the suction passage 3 downstream of the throttle 3. The valve 45 has a cylindrical member 51 which is moved by electromagnetic force in proportion to electric signals or current applied to the electromagnetic valve 45. The cylindrical member 51 has a needle valve 53 secured thereto. A needle of the needle valve 53 is inserted in an orifice 55 provided on the vacuum passage 49 whereby an open area defined by the orifice 55 and the needle is varied according to the movement of the needle valve 53. A pressure regulator 57 provided on the vacuum passage 49 between the suction passage 3 and the electromagnetic valve 45, is for making vacuum from the suction passage 3 a constant vacuum level, for example a value between 30 and 50 mmHg.

When an engine is accelerated with the throttle valve being opened, higher vacuum is established in the venturi portion 11. The vacuum is induced into the suction chamber 19 through the aperture 31 so that the suction piston 15 is elevated against the spring 21. The vacuum also, is induced into the pressure transducer 37 through the vacuum passage 39. The pressure transducer 37 transmits an electric signal proportional to the vacuum level applied thereto to the control unit 41. In the control unit 41, the electric signal is compared with the reference value to make a difference and electric signal proportional to the difference is transmitted to the electromagnetic valve 45. By the electromagnetic valve 45, the needle valve 53 is moved proportionally to the electric signal so that the open area of the orifice 55 will become larger. Vacuum in the suction passage 3 downstream of the throttle valve 7 is induced into the suction chamber 19 through the orifice 55, with the vacuum being controlled to a constant value by the pressure regulator 57. The suction piston 15 is further elevated by the vacuum from the suction passage 3 downstream of the throttle valve 7. Upon the elevation of the suction piston 15, the vacuum level in the venturi portion 11 is lowered to the reference value. When the pressure in the venturi portion 11 is equal to the reference value, the electromagnetic valve 45 closes the needle valve 53 so that it is kept constant. The suction chamber 19 is abruptly lowered in pressure so that the suction piston is abruptly elevated, because vacuum of higher level from the suction passage 3 downstream of the throttle valve 7 in addition to vacuum in the venturi portion 11 is induced into the suction chamber 19. Therefor, even if the acceleration of the engine occurs abruptly, the suction piston can be responded rapidly. By the elevation of the suction piston 15, an open area or gap 34 defined by the jet needle 27 and the orifice 33 is extended, an amount of fuel proportional to the section area of the gap 34 is sucked into the venturi portion 11 so that an air-fuel ratio is kept constant, whereby a preferable running condition of the engine can be obtained.

When the engine is decelerated with the throttle valve 7 being closed, the vacuum level in the venturi portion 11 is lowered. At this time the electromagnetic valve 45 is not moved but left closed, and vacuum lowered in its level in the venturi portion 11 is induced into the suction chamber 19 through the aperture 31, that is air in the venturi portion 11 is introduced into the suction chamber 19 through the aperture 31 so that the suction piston 15 is moved down until spring force and force due to vacuum in the suction chamber 19 are balanced.

According to Bernoulli's theorem in hydrodinamics, it is known that when a flow passage is constant in section area and pressure, the flow in the passage is fixed. In this embodiment, as pressure in the venturi portion 11 is controlled constant, an amount of the elevation of the suction piston 15 is proportional to air flow in the venturi portion 11. On the other hand, fuel is jetted into the venturi portion 11 through the cylinder 35 and the gap 34 defined by the orifice 31 and the jet needle 27, with the quantity of fuel flow being measured by the gap 34, and mixed with air in the venturi portion 11. Since a vacuum level in the venturi portion 11 or a force for extracting fuel from the float chamber is constant, the fuel flow is determined by the section area of the measuring gap 34. Therefore, the fuel flow to a displacement of the suction piston 15 (an air flow) is determined by making a shape of the jet needle 27 proper, and it is easy to make an air-fuel ratio constant.

The suction piston 15 is rapidly responsible to a pressure change in the venturi portion 11 because the pressure transducer 37 in which semi-conductor is used as strain gages is rapidly responsible to the pressure change and vacuum of a higher level than that in the venturi portion 11 is induced into the suction chamber 19 by the rapid operation of the electromagnetic valve 45 receiving electric signals from the pressure transducer 37. Therefore, even if the operation is changed abruptly, the suction piston 15 as well as the jet needle 27 is elevated rapidly in response to the pressure in the venturi portion 11 so that a proper amount of fuel and air is supplied without delay.

Figure 2:
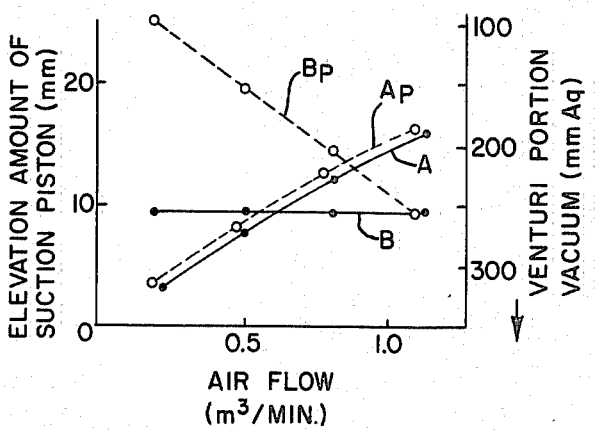
FIG. 2 shows graphes of relations between air flow and elevation of a suction piston and between the air flow and a vacuum level in a venturi portion.

In FIG. 2, solid lines A and B are concerning the embodiment shown in FIG. 1, dotted lines Ap and Bp are concerning a conventional carburetor which is not provided with the pressure transducer 37, the control unit 41 and the electromagnetic valve 45. Relations between an air flow and an elevating amount of the suction piston 15 are shown by A. Ap, and both of them increase as the air flow increases. On the other hand, as for relation B and Bp between the air flow and a vacuum level in the venturi portion 11, the vacuum level in the venturi portion 11 is constant in the former relation B obtained by using the embodiment shown in FIG. 1, the vacuum level in the venturi portion 11 is constant even if the air flow changes, and in the latter relation Bp, it increases as the air flow changes.

Figure 3:
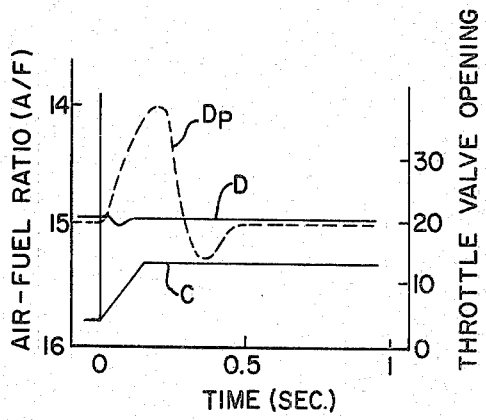
FIG. 3 shows graphes of relations between time and throttle valve opening and between the time and an air-fuel ratio.

FIG. 3 shows changes of air-fuel ratio (A/F) to time. In FIG. 3, a line C shows that the throttle valve is opened by 10 degree for short time, and kept at its opening. By this change of the throttle valve opening, an air-fuel ratio by the air valve type carburetor according to the embodiment shown in FIG. 1 is a little changed only at the time of the throttle valve opening change, and is not changed after then as shown by a line D. On the contrary, air-fuel ratio by the conventional air valve type carburetor is changed largely for about 0.5 sec. shown by a dotted line Dp.

As above-mentioned, the air valve type carburetor has an effect that air-fuel mixture of a fixed ratio can be supplied by controlling the control unit 41 in response to vacuum in the venturi portion 11, and introducing vacuum of high level in the suction passage 3 downstream of the throttle valve 7 into the suction chamber 19, in a transitional operation in addition to in a usual operation. Further it has advantages that running performance is increased, and that fuel saming and exhaust gas purifying can be effected.

For correcting the air-fuel level according to a condition of the exhaust gas, the pressure reference in the control unit 41 can be changed according to signal from a oxygen density detector which detects the exhaust gas condition through detecting oxygens.

What is claimed is:

1. An air valve type carburetor comprising:

a suction passage disposed substantially horizontally for introducing air and fuel into an engine;

a throttle valve disposed in the suction passage for controlling air and fuel introduced into the engine;

a venturi portion defined in the suction passage upstream of the throttle valve;

a fuel passage provided in the venturi portion for supplying fuel into the suction passage;

a suction chamber provided on the outside of the suction passage at the venturi portion;

a suction piston one end of which is disposed slidibly in the suction chamber and the other end of which is disposed in the suction passage so as to face the fuel passage and has an aperture through which the suction chamber communicates with the suction passage at the venturi portion;

a spring disposed in the suction chamber for urging the suction piston downward;

a jet needle provided on the lower end of the suction piston so that the jet needle will be inserted in the fuel passage, for regulating fuel flowing in the fuel passage;

means for detecting pressure in the venturi portion;

passage means for communicating between the suction chamber and the suction passage downstream of the throttle valve; and means connected to both the passage means and the means for detecting pressure, for controlling vacuum passing through the passage means so that the pressure in the venturi portion will be constant.

2. An air valve type carburetor as defined in claim 1, wherein the means for detecting pressure comprises a pressure transducer for detecting pressure and putting out electric signals according to the magnitude of the pressure, and a vacuum passage for inducing vacuum in the venturi portion into the pressure transducer.

3. An air valve type carburetor as defined in claim 2, wherein the means for controlling vacuum passing through the passage means includes an electromagnetic valve provided on the passage means, and a control unit for comparing the electric signals from the pressure transducer with a reference value to put out amplified electric signals corresponding to the difference value, the electromagnetic valve having a needle valve for controlling passage area of the passage means and moving the needle valve in response to the electric signals from the pressure transducer.

4. An air valve type carburetor as defined in claim 3, further including a pressure regulator provided on the passage means between the electromagnetic valve and the suction passage for regulating vacuum from the suction passage to a constant value.

5. An air valve type carburetor as defined in claim 4, wherein the pressure transducer is provided on a member defining the suction passage at the outside of the venturi portion, and the vacuum passage is formed in the member.

* * * * *